United States Patent [19]

Verhoof

[11] 4,275,137

[45] Jun. 23, 1981

[54] LIGHT-SENSITIVE DIAZOTYPE MATERIAL

[75] Inventor: Adrianus J. N. A. Verhoof, Maasbree, Netherlands

[73] Assignee: Oce-van der Grinten N.V., Venlo, Netherlands

[21] Appl. No.: 609,965

[22] Filed: Sep. 3, 1975

[30] Foreign Application Priority Data

Sep. 13, 1974 [NL] Netherlands ..... 7412151

[51] Int. Cl.[3] ..... G03C 1/60; G03C 1/87; G03C 5/34

[52] U.S. Cl. ..... 430/149; 430/160; 430/176; 430/177

[58] Field of Search ..... 96/91 R, 75, 49; 430/149, 160, 176, 177

[56] References Cited

U.S. PATENT DOCUMENTS

| | | | |
|---|---|---|---|
| 1,964,136 | 6/1934 | Prufer et al. | 96/91 R |
| 2,593,911 | 4/1952 | Neumann et al. | 96/91 R |
| 2,772,974 | 12/1956 | Kosalek et al. | 96/91 R |
| 2,778,735 | 1/1957 | Brinnick et al. | 96/75 |
| 3,244,523 | 4/1966 | Growold et al. | 96/75 |
| 3,271,155 | 9/1966 | Aebi | 96/91 R |
| 3,396,020 | 8/1968 | Borchers | 96/75 |
| 3,460,943 | 8/1969 | Welch | 96/91 R |
| 3,578,452 | 5/1971 | Parker | 96/49 |
| 3,615,537 | 10/1971 | Giesen et al. | 96/91 R |
| 3,624,021 | 11/1971 | Barba | 96/75 |
| 3,756,823 | 9/1973 | Ten Haaf et al. | 96/75 |
| 4,043,816 | 8/1977 | Bomers et al. | 96/49 |

FOREIGN PATENT DOCUMENTS

| | | | |
|---|---|---|---|
| 1169227 | 10/1969 | United Kingdom | 96/75 |
| 1212260 | 11/1970 | United Kingdom | 96/75 |

*Primary Examiner*—Charles L. Bowers, Jr.
*Attorney, Agent, or Firm*—Albert C. Johnston

[57] ABSTRACT

Diazotype material having a thin light-sensitive layer that is developable excellently by a limited application (1.5 to 4.5 $cm^3/m^2$) of a buffered aqueous solution of an azo component, and which adheres well to the support even in moist condition, can be obtained by providing on a paper support a light-sensitive layer containing a binder and filler with at least one diazo compound, when the binder comprises a condensation product of an amino compound with formaldehyde, e.g. cross-linked hexamethoxymethyl-melamine, and a hydrophilic polymer crosslinkable with said product, e.g. highly hydrolyzed polyvinyl alcohol, and the filler comprises starch particles, e.g. rice starch powder, in a weight proportion to said polymer of at least 5 to 1, and even as high as 30–70 to 1. A water-sealing layer on both sides of the support, or only on a side beneath the light-sensitive layer, renders the material curl resistant.

21 Claims, No Drawings

LIGHT-SENSITIVE DIAZOTYPE MATERIAL

This invention relates to diazotype material, more particularly to one-component diazotype material, which can be developed by the application of a small quantity of developing liquid.

Dutch patent application No. 72 07 099 described a process for the manufacture of diazotype copies, in which a one-component diazotype material is image-wise exposed and subsequently is developed, in order to form an azodye image, by spreading over the light-sensitive layer 1.5–4.5 $cm^3/m^2$ of a buffered, aqueous solution of one or more azo components. The diazotype paper to be used in the process according to that patent application, comprises a support carrying a more or less hydrophilic layer which contains a binder and filler and which has been so sensitized that after drying the diazo compound will have penetrated to an average depth of maximally 8 micrometers. The sensitizing is preferably carried out by applying over the hydrophilic layer 2–8 $cm^3/m^2$ of a suitably concentrated solution of a diazo compound.

In order to prevent curling of the freshly developed copies, a sealing layer is applied between the paper support and the hydrophilic layer, and preferably also on the rear side of the support. This sealing layer prevents the aqueous developing liquid from penetrating into the paper fibers.

The manufacture of non-curling or almost non-curling diazotype paper by coating both sides of a paper support with a sealing layer, subsequently coating on one side a more or less hydrophilic layer, and finally sensitizing the hydrophilic layer by applying a small quantity of a relatively concentrated solution of a diazo compound, is laborious and it requires a complicated coating machine when the diazotype paper is to be produced at high speed in one run through the machine.

The said patent application mentions the possibility of applying a hydrophilic light-sensitive layer onto the support in one coating operation by means of a liquid which contains with a diazo compound components for the formation of a hydrophilic layer. However, there is no mention of particular components by which a light-sensitive layer meeting all practical requirements can be so produced. The usual hydrophilic light-sensitive layers for diazotype papers contain a binder, such as polyvinyl alcohol, gelatin, gum arabic or polyvinyl acetate, and a filler, such as silica, sodium silicate, aluminium oxide or starch particles. Such layers have not been found particularly suitable for formation by the above mentioned process; they often appear to absorb insufficiently or too slowly the relatively concentrated developing liquid used for development of the copy, so that the images on the copy are developed incompletely and the copy does not feel almost dry immediately after the development. Other layers, which do absorb the developing liquid quickly and completely, appear to have too low an erasing resistance, especially in wet condition immediately upon the development of the copy, and/or to adhere insufficiently to a more or less hydrophobic water-sealing layer which preferably is applied to the paper support.

The present invention provides diazotype material having an improved light-sensitive layer which can be applied in one coating operation onto a paper support, or onto a more or less hydrophobic, water-sealing layer present on this support, and which, besides being developable in the usual way, can be developed excellently according to the process described in said Dutch patent application.

The improved light-sensitive layer of the diazotype material according to the invention contains at least one diazo compound, a condensation product of an amino compound with formaldehyde, a hydrophilic water-soluble polymer and starch particles, with the weight proportion of starch particles to hydrophilic polymer being at least five to one. At an average layer thickness of not more than 8 micrometers light-sensitive layers having this composition are capable of quickly and completely absorbing 1.5–4.5 $cm^3/m^2$ of a relatively concentrated developing liquid, such as that required in the above-mentioned process. These improved layers, moreover, notwithstanding their high filler content, and even in wet condition, adhere well to water-sealing layers formed with the usual, more or less hydrophobic, film forming binders.

The condensation product of an amino compound with formaldehyde, hereinafter referred to as amino-formaldehyde condensate, is selected from the known condensation products of this type derived from urea or melamine or their derivatives or from a guanamine, such as for instance benzoguanamine. Preferably amino-formaldehyde condensates are used which are formed by cross-linking, in the sensitizing liquid with which the light-sensitive layer is formed, precursor amino-formaldehyde condensates, i.e., pre-condensates, that can be dissolved or dispersed in the aqueous sensitizing liquid. During the drying of the light-sensitive layer from liquid state the amino-formaldehyde pre-condensate crosslinks with itself, and probably also with other components such as the hydrophilic polymer, so that a light-sensitive layer is formed which is insoluble in water.

Suitable amino-formaldehyde pre-condensates which can be dissolved or dispersed in water include: dimethylol-urea, dimethylolmethyl-urea, dimethylol-melamine, hexamethylol-melamine, as well as their wholly or partially etherified derivatives such as dimethyloltetramethoxymethyl-melamine, dimethyloltetrabutoxymethyl-melamine and hexamethoxymethyl-melamine. Hexamethoxymethyl-melamine is preferred, because at room temperature this substance is relatively stable yet it crosslinks very quickly at slightly increased temperature.

In order to promote rapid crosslinking of the amino-formaldehyde pre-condensate during the drying of the light-sensitive layer, a crosslinking catalyst may be incorporated in the layer. The catalyst to be used can be any of the acids or acid salts known to be effective, among which are, for instance, hydrochloric acid, sulphuric acid, formic acid, acetic acid, benzene sulphonic acids such as p-toluene-sulphonic acid, ammonium chloride, ammonium sulphate and aluminum sulphate.

The quantity of amino-formaldehyde condensate to be employed in the light-sensitive layer is determined on the one hand by the requirement that immediately upon development, also in wet condition, the light-sensitive layer must adhere sufficiently to a more or less hydrophobic underlayer, and on the other hand by the requirement that the light-sensitive layer must be capable of quickly and completely absorbing 1.5–4.5 $cm^3/m^2$ of aqueous developing liquid. Too low a concentration of amino-formaldehyde condensate results in layers which adhere insufficiently to a more or less hydrophobic underlayer, and of which the erasive resistance in wet layer condition usually is too low. Too high a concentration of amino-formaldehyde condensate results in relatively closed light-sensitive layers, into which the developing liquid penetrates slowly. In general, the weight proportion of amino-formaldehyde condensate to hydrophilic polymer lies between 1 to 0.1 and 1 to 10.

The optimal quantity of amino-formaldehyde condensate depends on the type of amino-formaldehyde pre-condensate used, as well as on the weight proportion of starch particles to hydrophilic polymer. In the use of hexamethoxymethyl-melamine, the most favorable weight proportion of this pre-condensate to the hydrophilic polymer generally amounts to 1 to 0.2–2.5 when the light-sensitive layer contains more than about 20 parts by weight of starch particles per part by weight of hydrophilic polymer, and to 1 to 2–8 when the layer contains 5 to 20 parts by weight of starch particles per part by weight of hydrophilic polymer. When other amino-formaldehyde pre-condensates such as dimethylol-urea or dimethylol-melamine are used, a larger quantity of amino-formaldehyde pre-condensate is necessary and the most favorable weight proportion usually amounts to 1 to 0.1–1.

The light-sensitive layer may contain as the hydrophilic water-soluble polymer any of the known water-soluble hydrophilic polymers which carry groups reactive to an amino-formaldehyde pre-condensate. Examples of suitable hydrophilic polymers are: polyvinyl alcohol, gum arabic, gelatin, water-soluble cellulose ethers such as methyl cellulose and hydroxyethyl cellulose, and water-soluble starch products such as hydrolyzed starch and dextrin. Highly effective hydrophilic polymers are water-soluble starch products and polyvinyl alcohols, especially high molecular weight polyvinyl alcohols having a degree of hydrolysis greater than 75%, preferably 98–100%.

The light-sensitive layer contains as a filler starch particles in a weight proportion to the hydrophilic polymer of at least 5 to 1. In materials which have opaque paper as the support, the weight proportion of starch particles to hydrophilic polymer preferably amounts to 30–70 to 1. In this way azodye images having a very high intensity are obtained upon developing the diazotype material. The adhesion of the light-sensitive layers containing such a high concentration of starch particles to a more or less hydrophobic underlayer is amply sufficient, even when the light-sensitive layer is in wet condition. In materials having a transparent support, such as, for instance, natural transparent paper, the weight proportion of starch particles to hydrophilic polymer preferably amounts to 5–20 to 1, because in this case azodye images having the highest ultraviolet absorption are obtained upon development.

The starch particles in the light-sensitive layer can consist of, for instance, rice starch, wheat starch or corn starch. Preferably rice starch is used, because this product has a greater whiteness than other starches, and because, by virtue of a relatively lower spread of the particle sizes, more uniform layers can be obtained with rice starch.

Besides starch particles the light-sensitive layer may also contain other fillers known for use in diazotype layers, such as silica, sodium silicate, and aluminum oxide. However, the quantity of other filler in the light-sensitive layer must be smaller than the quantity of starch particles, and preferably does not amount to more than 70 weight percent of the quantity of starch particles present.

The light-sensitive diazo compound to be used can be selected as desired from the diazo compounds known for use in diazotype materials. In general these are benzene-diazo compounds which in the 4-position relative to the diazo group carry a tertiary amino group, a secondary acylamino group, a phenyl group or an etherified mercapto group, and which in one or two remaining positions have been further substituted by a halogen atom, an alkyl, alkoxy, phenoxy or tertiary acylamino group or a combination of such further substituents.

In the use of the improved diazotype material in a process according to the aforesaid patent application, the best results are obtained when the material contains a diazo compound that in vitro couples more actively than 4-diazo-2-chloro-N.N.-diethylaniline. Such actively coupling diazo compounds are described, for instance, in British patent specifications Nos. 919 037, 919 812, 1 045 242, 1 064 128 and 1 064 129 and Belgian patent specification Nos. 657 907, 665 368 and 661 008. The method for determining the coupling activity of the diazo compounds is described in British patent specification 957 386. The development of such diazotype material preferably is effected with a weakly-acid buffered solution of an azo component. If an alkaline azo component solution is to be used for the development, the diazotype material can also be sensitized with compounds having lower coupling speed, for instance, with diazo compounds as described in British patent specification Nos. 867 630, 875 307, 888 598, French patent specification Nos. 1 269 874, 1 269 875, 1 269 876, Belgian patent specification No. 574 785, Dutch patent application No. 69 12 554 and German patent application No. 2 003 508.

The light-sensitive layer may also contain auxiliary agents as commonly used in diazotype materials. Among such agents are acid stabilizers, for instance citric acid, tartaric acid, boric acid, benzene sulphonic acids and naphthalene sulphonic acids, anti-yellowing agents and developing accelerators.

The support for the light-sensitive layers according to the invention can be any of the known paper support materials, such as opaque paper, natural transparent paper and transparentized paper.

For the use of the improved diazotype material in the process of the aforesaid Dutch patent application, a water-sealing layer is coated between the paper support and the light-sensitive layer in order to prevent too deep a penetration of the sensitizing liquid and avoid curling of the diazotype copy immediately after the development. The water-sealing layer can be formed with the known more or less hydrophobic film-forming polymers or with mixtures of such polymers. Examples of suitable polymers are: polyvinyl acetate, polyvinyl chloride, polyacrylates and polymethacrylates, copolymers of vinyl acetate with vinyl chloride and, if so desired, an unsaturated carboxylic acid, copolymers of styrene with butadiene and optionally acrylonitrile, copolymers of styrene with acrylonitrile and copolymers of acrylonitrile with butadiene.

The water-sealing layer may also contain a filler, such as kaolin or other clay, diatomaceous earth, talc, silica, barium sulphate, titanium dioxide, zinc oxide or aluminum oxide, or mixtures of these; but the content of filler may not be so high that the layer becomes water-permeable. In general the weight proportion of filler to polymer in the water-sealing layer should be lower than 1:1.

The sealing layer can be formed by applying to the support a solution of the polymer or mixture of polymers in a suitable solvent or mixture of solvents, or a dispersion of the polymer in water or in a mixture of water with one or more water-miscible organic solvents. Polyvinyl acetate layers formed from an aqueous dispersion are highly effective water-sealing layers, as also are filler-containing layers of a copolymer of 50–75 weight percent of styrene with 50–25 weight percent of butadiene, in which the weight proportion of filler to polymer amounts to 0.25–0.75 to 1.

The light-sensitive layer is applied onto the support, or onto the sealing layer present on it, in the form of an aqueous liquid which can contain a wetting agent. The layer applied is dried at elevated temperature, whereby crosslinking of the precursor amino-formaldehyde condensate takes place. During the drying the surface temperature of the diazotype material is preferably not raised above 60° to 70° C., because at higher temperatures there is risk of thermal decomposition of the diazo compound. Drying is effected until the moisture content of the diazotype material is reduced to 2–4 weight percent.

If the amino-formaldehyde condensate is insufficiently crosslinked upon drying, which becomes observable in an insufficient adhesion of the light-sensitive layer to the water-sealing layer, further crosslinking can be induced by storing the diazotype material in the dark for a few hours at room temperature or slightly elevated temperature (30°–40° C.).

Especially when the diazotype material is to be used in the process according to said Dutch patent application, the thickness of the light-sensitive layer should not amount on the average to more than 8 micrometers, which corresponds with a dry layer weight of about 8 $g/m^2$. Preferably the dry weight of the light-sensitive layer amounts to 4–7 $g/m^2$. Notwithstanding their very small thickness, these light-sensitive layers are capable of absorbing 1.5–4.5 $cm^3m/^2$ of aqueous developing liquid quickly and completely.

The light-sensitive layers according to the invention may also contain, besides at least on diazo compound, an azo component or a mixture of azo components. Layers so composed can be developed by applying a small quantity of alkaline developing liquid, which now need not contain an azo component. These layers can be developed excellently, for instance, by the process described in U.S. Pat. No. 3,446,620, whereby about 3 $cm^3/m^2$ of concentrated amine solution is spread over the light-sensitive layer. Of course, such layers can also be developed in the conventional way in ammonia vapor or other alkaline vapors.

EXAMPLE 1

Diazotype support paper weighing 65 $g/m^2$ was provided on both sides with a sealing layer of 5 $g/m^2$ dry weight by applying a liquid of the composition:

40 ml of a 50% (approx.) aqueous dispersion of a copolymer of 70 weight percent styrene with 30 weight percent butadiene,
8 g of amorphous silica having an elemental particle size of about 30 nanometers, and
60 ml of water.

Subsequently one side of the paper was provided with a light-sensitive layer of about 7 $g/m^2$ dry weight, by applying a liquid of the composition:

2 g of 4-dimethyamino-3-(4'-chlorophenoxy)-6-chlorobenzene diazoniumhydrogen sulphate,
0.5 g of high molecular weight polyvinyl alcohol, of 98% degree of hydrolysis (Elvanol 72–60 of Du Pont de Nemours and Co., U.S.A.),
25 g of rice starch,
0.5 ml of hexamethoxymethyl-melamine, and water up to 100 ml.

The wet light-sensitive layer obtained was dried by heating the paper up to 60°–70° C., until the moisture content of the paper amounted to about 4 weight percent. The diazo-type material obtained was exposed under a line original, until the diazo compound in areas beneath the blank portions of the original had completely been bleached away. Subsequently the exposed material was developed in a developing device as described in Dutch patent application, whereby 3.5 $cm^3/m^2$ of developing liquid of the following composition was applied:

29 g of phloroglucinol,
89 g of succinic acid,
potassium hydroxide to bring the pH of the liquid to 6.0, and
water up to 1 l.

The copy obtained did not curl, felt dry almost immediately, and showed a strongly black image on a clear background. Also, when the copy still was in moist condition, immediately after the development, the image layer well adhered to the sealing layer; even by rubbing the image layer could hardly be removed from the underlayer.

When either of the following liquids A or B was used for the sensitization, a diazotype material was obtained of which the light-sensitive layer adhered insufficiently to the underlayer, especially immediately after the development, and could easily be removed from the underlayer by rubbing. The easy erasure was especially notable when using liquid B. The paper obtained with liquid A showed, moreover, a lower developing speed than the paper according to the invention.

Liquid A:
2 g of 4-dimethylamino-3-(4'-chlorophenoxy)-6-chlorobenzene diazoniumhydrogen sulphate,
0.5 g of polyvinyl alcohol (Elvanol 72–60 of Du Pont de Nemours and Co.),
12 g of rice starch, and
water up to 100 ml.

Liquid B:
As liquid A, but now with 25 g of rice starch.

EXAMPLE 2

Diazotype support paper weighing 65 $g/m^2$ was provided on each side with a water-sealing layer as described in the preceding example, and was subsequently provided on one side with a light-sensitive layer of about 6 $g/m^2$ dry weight by applying the following sensitizing liquids A, B and C separately to different samples:

Liquid A:
1.5 g of 4-dimethylamino-3-(4'-chlorophenoxy-6-chlorobenzene diazoniumhydrogen sulphate,
3.5 g of hydrolyzed starch (Farinex TSD of Nationale Zetmeel Industrie, Delft),
0.5 ml of hexamethoxymethyl-melamine,
30 g of rice starch, and
water up to 100 ml.

Liquid B:
As A, but now with 0.5 g of hydrolyzed starch instead of 3.5 g.

Liquid C:

As A, but now with 0.5 g of hydrolyzed starch, instead of 3.5 g, and 1 ml of hexamethoxymethylmelamine instead of 0.5 ml.

The three diazotype papers so obtained were imagewise exposed and developed in the way described in Example 1. In all cases the copies obtained did not curl, felt dry almost immediately after the development, and showed a strongly black image on a clear background. In all cases the light-sensitive layer adhered well to the water-sealing layer.

EXAMPLE 3

Diazotype support paper weighing 65 g/m$^2$ was provided with a water-sealing layer on each side, in the way described in Example 1, and was subsequently provided on one side with a light-sensitive layer of about 6 g/m$^2$ dry weight by applying the following sensitizing liquids A and B separately to different samples:

Liquid A:
- 1.5 g of 4-N-methyl-N-cyclohexylamino-3-methoxy-2-N-methyl-N-ethoxycarbonylamino-benzene diazoniumhydrogen sulphate,
- 0.5 g of polyvinyl alcohol having a degree of hydrolysis above 98% (Gohsenol NH 26 of Nippon Gohsei, Osaka, Japan),
- 35 g of wheat starch,
- 0.5 g of hexamethoxymethyl-melamine, and water up to 100 ml.

Liquid B:
- As A, but now with 35 g of maize starch instead of 35 g of wheat starch.

The diazotype papers so obtained were imagewise exposed and developed as described in Example 1. The copies obtained did not curl, felt dry almost immediately after the development, and showed a strongly black image on a clear background. The image layer of the copies in moist condition also adhered well to the water-sealing layer.

EXAMPLE 4

Natural transparent paper weighing 75 g/m$^2$ was provided on both sides with a water-sealing layer of about 2.5 g/m$^2$ dry weight, by applying a liquid of the composition:
- 50 ml of a 50% (approx.) aqueous dispersion of a copolymer of 60 weight percent styrene with 40 weight percent butadiene, and
- 50 ml of ethanol.

Subsequently one side of the paper was provided with a light-sensitive layer of about 5 g/m$^2$ dry weight, by applying a sensitizing liquid containing:
- 2.7 g of 4-N-benzoylamino-2-N-methyl-N-ethoxycarbonylamino-5-methoxybenzene diazoniumhydrogen sulphate,
- 0.5 ml of hexamethoxymethyl-melamine,
- 3 g of methyl cellulose,
- 20 g of rice starch,
- 0.02 g of p-toluene sulphonic acid, and
- water up to 100 ml.

The light-sensitive layer was dried at about 60° C. until the moisture content of the paper remained at about 4 weight percent.

The diazotype material obtained was exposed under a line original until the diazo compound had just been bleached out under the clear portions of the original, and was subsequently developed as described in Example 1. The copy obtained did not curl, and showed a strong brown image on a clear background. The image layer of the freshly developed copy adhered well to the water-sealing underlayer. The copy could be used as intermediate original for further copying on diazotype paper.

Similar results were obtained when light-sensitive layers were formed on other portions of the same paper, over the same water-sealing layer thereon, by applying the following sensitizing liquids A, B and C:

Liquid A:
- 2.5 g of 4-N-benzoylamino-2-N-methyl-N-ethoxycarbonyl-amino-5-methoxybenzene diazoniumhydrogen sulphate,
- 0.5 ml of hexamethoxymethyl-melamine,
- 2 g of high molecular weight polyvinyl alcohol having a degree of hydrolysis above 98% (Gohsenol NH 26),
- 12 g of rice starch,
- 30 ml of a 20% (approx.) aqueous dispersion of colloidal silica, stabilized with acid, and
- water up to 100 ml.

Liquid B:
- 2.7 g of the diazonium salt of liquid A,
- 0.5 ml of hexamethoxymethyl-melamine,
- 3 g of polyvinyl alcohol (Gohsenol NH 26),
- 15 g of rice starch, and
- water up to 100 ml.

Liquid C:
- 2.5 g of the diazonium salt of liquid A,
- 1 ml of hexamethoxymethyl-melamine,
- 2 g of polyvinyl alcohol (Gohsenol NH 26),
- 30 g of rice starch, and
- water up to 100 ml.

EXAMPLE 5

Diazotype support paper weighing 65 g/m$^2$ was provided on both sides with a water-sealing layer in the way described in Example 1, after which on one side a light-sensitive layer of about 5 g/m$^2$ dry weight was formed by applying a liquid containing:
- 1.8 g of 4-dimethylamino-3-(4'-chlorophenoxy)-6-chlorobenzene diazonium-hydrogen sulphate,
- 3 g of dimethylol-urea,
- 0.5 g of polyvinyl alcohol (Gohsenol NH 26),
- 30 g of rice starch,
- 0.02 g of p-toluene sulphonic acid, and
- water up to 100 ml.

The light-sensitive layer was dried and hardened by heating the material for about 30 seconds at about 50° C., and subsequently by storing it in a dark room at 35° C. for about 24 hours.

The diazotype material was imagewise exposed and developed in the way described in Example 1. A non-curling copy having a strongly black image was obtained. The image layer of the copy adhered well to the water-sealing layer.

EXAMPLE 6

Three sheets of diazotype support paper weighing 65 g/m$^2$ were provided on both sides with a water-sealing layer of about 4 g/m$^2$ dry weight by applying, respectively, the following liquids A, B and C:

Liquid A:
- 60 ml of a 50% (approx.) aqueous dispersion of polyvinyl acetate and
- 40 ml of water.

Liquid B:

40 ml of a 50% (approx.) aqueous dispersion of a copolymer of vinyl proprionate with an acrylic acid ester (Probiofan 540 D of B.A.S.F., Germany),
12 g of amorphous silica, and
water up to 100 ml.
Liquid C:
45 ml of a 40% (approx.) aqueous dispersion of a carboxylated copolymer of acrylonitrile with butadiene (Synthomer 7014 of Synthomer Chemie GmbH, Germany),
10 g of amorphous silica, and
water up to 100 ml.

The three support materials thus obtained were provided on one side with a light-sensitive layer of about 6 g/m$^2$ dry weight by applying the sensitizing liquid described in Example 1. The diazotype materials thus obtained were imagewise exposed and developed as described in Example 1.

In all cases non-curling copies having a strongly black image were obtained, and the image layer of each copy adhered well to the water-sealing underlayer.

Similar good results were obtained when the support materials were sensitized with a liquid containing:
2 g of 4-dimethylamino-3-(4'-chlorophenoxy)-6-chlorobenzene diazonium-hydrogen sulphate,
0.5 g of gum arabic,
30 g of rice starch,
0.5 ml of hexamethoxymethyl-melamine, and
water up to 100 ml.

EXAMPLE 7

Diazotype support paper weighing 65 g/m$^2$ was provided on both sides with a water-sealing layer in the way described in Example 1 and subsequently was provided on one side with a light-sensitive layer of about 6 g/m$^2$ dry weight by applying a liquid containing:
1 g of 4-N-ethyl-N-(2'hydroxyethyl)aminobenzene diazonium-chlorozincate,
3 g of tartaric acid,
1 g of 2,3-dihydroxynaphthalene-6-sulphonic acid,
0.5 g of polyvinyl alcohol (Gohsenol NH 26),
20 g of rice starch,
0.2 ml of hexamethoxymethyl-melamine, and
water up to 100 ml.

The diazotype material was exposed under a line original and was subsequently developed by spreading about 3 cm$^3$/m$^2$ of developing liquid of the following composition over the light-sensitive layer:
48 ml of triethanolamine,
43.5 ml of diethyleneglycol monomethylether, and
8.5 ml of oleic acid.

The copy obtained showed a blue image on a clear background.

I claim:

1. Diazotype material comprising a paper support and on at least one side thereof, in order, a substantially hydrophobic water sealing layer and on said sealing layer a substantially water-insoluble light-sensitive layer of not more than 8 g/m$^2$ dry weight consisting essentially of a light-sensitive diazonium compound, an amino-formaldehyde condensate produced by cross-linking of an amino-formaldehyde pre-condensate in the presence of an initially water-soluble, hydrophilic polymer that contains groups reactive to said precondensate, and finely divided filler, said filler consisting predominantly by weight of starch particles in a weight ratio to said hydrophilic polymer of at least 5 to 1, said condensate being present in a quantity rendering said light-sensitive layer firmly adherent to said sealing layer, and said material being substantially non-curling, in either dry or moist condition, said light-sensitive layer after imagewise exposure being developable into a strong image by and capable of absorbing completely 1.5 to 4.5 cm$^3$/m$^2$ of an aqueous developing liquid.

2. Diazotype material according to claim 1, said amino-formaldehyde condensate being cross-linked a derivative of urea or melamine.

3. Diazotype material according to claim 1, said amino-formaldehyde condensate being hexamethoxymethyl-melamine.

4. Diazotype material according to claim 1, said light-sensitive layer also containing an acidly reacting cross-linking catalyst.

5. Diazotype material according to claim 1, the content of said hydrophilic polymer amounting to 0.1–10 parts by weight thereof per part by weight of said amino-formaldehyde condensate.

6. Diazotype material according to claim 1, said hydrophilic polymer being a polyvinyl alcohol having a degree of hydrolysis greater than 75%.

7. Diazotype material according to claim 1, said hydrophilic polymer being a water-soluble starch product.

8. Diazotype material according to claim 1, the weight proportion of said starch particles to said hydrophilic polymer amounting to 30–70 to 1.

9. Diazotype material according to claim 1, said starch particles being particles of rice starch.

10. Diazotype material according to claim 1, said water-sealing layer containing a hydrophobic film-forming organic polymer.

11. Diazotype material according to claim 1, said condensate having been produced in situ by heating and drying on said sealing layer a layer of an aqueous liquid containing said diazonium compound, said pre-condensate, said polymer and said filler.

12. Diazotype material according to claim 1, wherein the amino group of said condensate is derived from urea, melamine or benzoguanamine, said hydrophilic polymer is a polyvinyl alcohol having a degree of hydrolysis greater than 75 percent and the amount of hydrophilic polymer is from 0.1 to 10 parts by weight per part of said pre-condensate, said starch particles being present in a weight ratio to said hydrophilic polymer not exceeding 70 to 1.

13. Diazotype material according to claim 12, said water-sealing layer containing a hydrophobic film-forming organic polymer.

14. Diazotype material according to claim 12 wherein the amino group of said amino-formaldehyde condensate is derived from urea.

15. Diazotype material according to claim 12 wherein the amino group of said amino-formaldehyde condensate is derived from melamine.

16. Diazotype material according to claim 12 wherein the amino group of said amino formaldehyde condensate is derived from benzoguanamine.

17. A process for the production of diazotype copies, wherein a diazotype material as claimed in claim 1 is imagewise exposed and subsequently is developed by spreading 1.5–4.5 cm$^3$/m$^2$ of developing liquid over the light-sensitive side of the diazotype material.

18. Diazotype material comprising a paper support, a hydrophobic water sealing layer on at least one side of said support, and on and adhering to said sealing layer at one side of said support a substantially water-insoluble light-sensitive layer of not more than 8 g/m$^2$ dry weight consisting essentially of a light-sensitive diazonium compound, a substantially water-insoluble product of the cross-linking in situ of an initially water soluble hexamethoxymethyl-melamine in the presence of between 0.1 and 10 parts by weight, per part of hexamethoxymethyl-melamine, of initially water-soluble polyvinyl alcohol having a degree of hydrolysis greater than 75 percent and finely divided filler, said filler consisting at least predominantly by weight of starch particles in a weight ratio of said polyvinyl alcohol of between 5 and 70 to 1, said light-sensitive layer after imagewise exposure being developable into a strong image by and capable of absorbing completely 1.5 to 4.5 cm$^3$/m$^2$ of an aqueous developing liquid, said light-sensitive layer being firmly adherent to said sealing layer and said material being substantially non-curling in either dry or moist condition.

19. Diazotype material according to claim 18, said polyvinyl alcohol having a degree of hydrolysis of about 98 to 100%.

20. Diazotype material according to claim 18, said light-sensitive layer containing about 0.2 to 2.5 parts by weight of said polyvinyl alcohol per part of hexamethoxymethylmelamine and more than 20 parts by weight of starch particles per part of polyvinyl alcohol.

21. Diazotype material material according to claim 18, said light-sensitive layer containing about 2 to 8 parts by weight of said polyvinyl alcohol per part of hexamethoxymethyl-melamine and about 5 to 20 parts by weight of starch particles per part of polyvinyl alcohol.

* * * * *